US009020405B2

(12) United States Patent
Gibson et al.

(10) Patent No.: US 9,020,405 B2
(45) Date of Patent: Apr. 28, 2015

(54) BIAS MEMBER FOR THE DOCTOR BLADE OF THE DEVELOPER UNIT IN AN IMAGING DEVICE

(75) Inventors: Nicholas Fenley Gibson, Lexington, KY (US); Brad Edward Mattingly, Lexington, KY (US); Benjamin Keith Newman, Lexington, KY (US)

(73) Assignee: Lexmark International, Inc. KY (US)

( * ) Notice: Subject to any disclaimer, the term of this patent is extended or adjusted under 35 U.S.C. 154(b) by 0 days.

(21) Appl. No.: 13/369,639

(22) Filed: Feb. 9, 2012

(65) Prior Publication Data

US 2013/0183068 A1 Jul. 18, 2013

Related U.S. Application Data

(60) Provisional application No. 61/586,102, filed on Jan. 12, 2012.

(51) Int. Cl.
*G03G 15/08* (2006.01)
*G03G 21/00* (2006.01)

(52) U.S. Cl.
CPC ..... *G03G 15/0812* (2013.01); *G03G 21/0029* (2013.01)

(58) Field of Classification Search
USPC ..... 399/350
See application file for complete search history.

(56) References Cited

U.S. PATENT DOCUMENTS

| | | | | |
|---|---|---|---|---|
| 4,585,328 | A * | 4/1986 | Moser et al. | 118/261 |
| 5,388,515 | A | 2/1995 | Schneider et al. | |
| 7,233,760 | B2 | 6/2007 | Buchanan | |
| 7,711,286 | B2 * | 5/2010 | Oda et al. | 399/102 |
| 2006/0127137 | A1 * | 6/2006 | Buchanan | 399/284 |
| 2011/0050801 | A1 | 3/2011 | Uemura | |

OTHER PUBLICATIONS

International Search Report and Written Opinion of the International Searching Authority for PCT application PCT/US2013/021176, Mar. 7, 2013.

* cited by examiner

*Primary Examiner* — Clayton E Laballe
*Assistant Examiner* — Jas Sanghera

(57) ABSTRACT

A doctor blade assembly for the developer unit of an electrophotographic imaging system. The doctor blade assembly includes a blade member having a first longitudinal edge for contacting a developer roll of an imaging system; a bracket member operatively connected to the blade member; and at least one bias member having a first end portion along a first longitudinal end portion of the bracket member and a second end portion contacting a distal portion of the blade member so as to present a force thereon. The force presented by the bias member serves as a counterforce to at least partly offset a force presented on the doctor blade and developer roll by a seal member of the developer unit.

34 Claims, 14 Drawing Sheets

BIAS MEMBER FOR THE DOCTOR BLADE OF THE DEVELOPER UNIT IN AN IMAGING DEVICE

CROSS REFERENCES TO RELATED APPLICATIONS

Pursuant to 35 U.S.C. §119, this application claims the benefit of the earlier filing date of Provisional Application Ser. No. 61/586,102, filed Jan. 12, 2012, entitled "Bias Member for the Doctor Blade of the Developer Unit in an Imaging Device," the content of which is hereby incorporated by reference herein in its entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to electrophotographic imaging devices such as a printer or multifunction device having printing capability, and in particular to a mechanism for counterbalancing forces that are presented onto the doctor blade of an electrophotographic device's developer unit by end seals thereof.

2. Description of the Related Art

Laser printers utilize a light beam which is focused to expose a discreet portion of a photoconductive or image transfer drum in an attempt to attract printing toner to these discreet portions. This photoconductive drum assembly is made out of highly photoconductive material that is discharged by light photons typically embodied by a laser. Initially, the drum is given a charge by a charge roller. As the photoconductive drum revolves, the printer shines a laser beam across the surface to discharge certain points. In this way, the laser "draws" the letters and images to be printed as a pattern of electrical charges, forming an electrostatic latent image. The system can also work with either a more positively charged electrostatic latent image on more negatively charged background or a more negatively charged electrostatic latent image on a more positively charge background.

When the toner becomes electrostatically charged, the toner is attracted to exposed portions of the photoconductive drum. After the data image pattern is set, charged toner is supplied to the photoconductive drum. Because of the charge differential, the toner is attracted to and clings to the discharged areas of the drum, but not to the similarly charged "background" portions of the photoconductive drum. With the image data toner pattern on the photoconductive drum, the drum engages a sheet of paper or media moving adjacent thereto. The paper or other media may be driven by a transport belt or transfer roller, which is oppositely charged to the toner causing it to transfer to the paper or other media. This charge is stronger than the charge of the electrostatic image, so the transfer roller pulls the toner away from the surface of the photoconductive drum. When the printing media passes beneath the rotating photoconductive drum, the toned image is transferred to the media. The transferred toner is subsequently fused to the paper typically by application of heat and pressure.

Toner to be used is initially stored in a removable container often located in a toner cartridge. The printer gathers the toner from the toner container and supplies it to a developer unit using paddles and transfer rollers. The developer unit may be located in the toner cartridge or separate therefrom. A developer roll is a charged rotating roller, typically with a conductive metal shaft and a polymeric conductive coating, which receives toner from a toner adder roll positioned adjacent the developer roll in the developer unit. Due to electrical charge and mechanical scrubbing, the developer roll collects toner particles from the toner adder roll. A doctor blade assembly engages the developer roll to provide a consistent coating of toner along the length and surface of developer roll, by scraping or "doctoring" excess toner from the developer roll and metering a thin layer of toner on the developer roll surface. In turn, this provides a consistent supply of toner to the photoconductive drum. Without a doctor blade, the coating of toner on the developer roll may be inconsistent, too thick, too thin or bare, thereby causing the amount of toner presented to the latent image on the photoconductive drum to be inconsistent and the level of darkness of the printed image may vary as a result, which is considered a print defect.

One challenge with existing doctor blade assemblies is that of providing a consistent seal generally around the location where the doctor blade assembly, the developer roll and the developer unit housing meet. Seals, including J-seals, have been found to effectively inhibit toner leakage in this area. However, J-seals prevent toner leakage through contact with the doctor blade and developer roll. Such contact results in nonuniform nip pressure between the doctor blade and the developer roll by providing a greater force at the ends thereof than the middle. This greater force at the ends creates a thinner layer of toner and higher charged toner on the toner layer disposed on the developer roll which increases background printing along the ends of the printed image. The greater force between the doctor blade and the developer roll also generates more heat at the ends of the doctor blade, thereby resulting in shorter life of the doctor blade and developer unit. The greater force at the ends of doctor blade increases the wear rate of the doctor blade and shortens the life of the doctor blade. The heat generated may potentially cause toner to melt on the developer roll, which will damage the developer unit.

Based upon the foregoing, there is a need for a developer unit for an electrophotographic imaging device having improved printing performance and useful life.

SUMMARY

Example embodiments of the present disclosure overcome shortcomings of existing developer units and thereby satisfy a significant need for a developer unit which serves to at least partly offset forces presented to the doctor blade and developer roll by the J-seals of the developer unit. In accordance with an example embodiment, there is disclosed a developer unit housing; a developer roll disposed within the housing and having a shaft which extends from at least one side thereof; and at least one seal member coupled within the housing along the at least one side thereof, a portion of the at least one seal member engaging the developer roll so as to prevent toner from leaking from the housing. In addition, the developer unit includes a doctor blade assembly coupled to the housing, including a support bracket for securement of the blade assembly within the housing, a doctor blade coupled to the support bracket and positioned so that a distal end thereof is disposed between and engages with the developer roll and the at least one seal member, and at least one bias member having a first end portion coupled to the support bracket and a second end portion which engages with the doctor blade so as to present a force that at least partly offsets a force presented to the doctor blade and developer roll by the at least one seal member. By providing a force at least partly offsetting the force presented by the seal member, the pressure between the doctor blade and developer roll is more uniform with less heat generated during printing which results in less defects and longer developer unit life. The more uniform pressure also provides a more uniform mass and charge of the layer of toner on the developer roll. The use of a bias member at each end of the doctor blade results in the doctor blade having less wear at its ends.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings, wherein.

DETAILED DESCRIPTION

Figure 1:
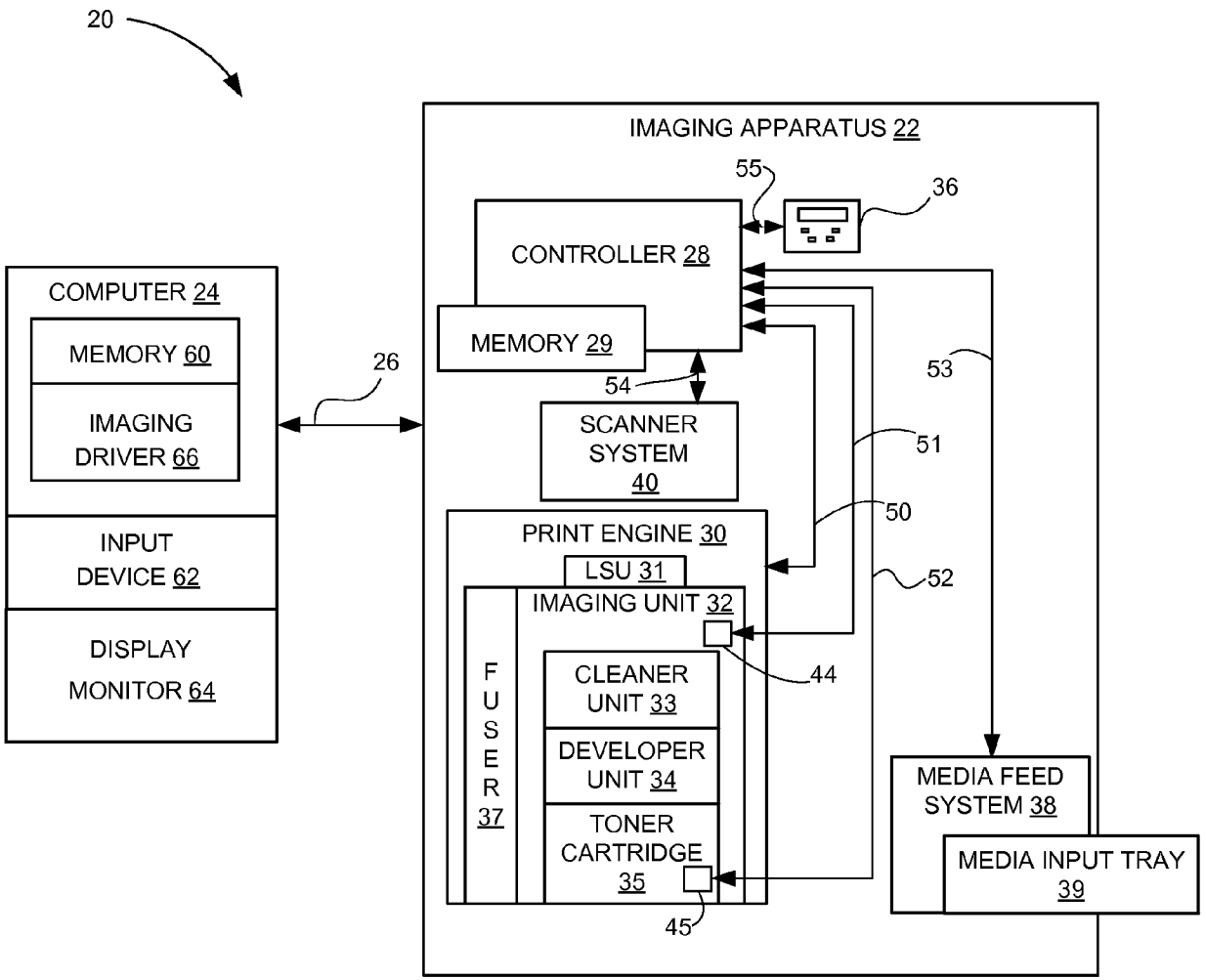
FIG. 1 is a block diagram of an example imaging system utilizing the imaging unit of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

In FIG. 1, there is shown a diagrammatic depiction of an imaging system 20 embodying the present disclosure. As shown, imaging system 20 may include an imaging apparatus 22 and a computer 24. Imaging apparatus 22 communicates with computer 24 via a communications link 26. As used herein, the term "communications link" is used to generally refer to any structure that facilitates electronic communication between multiple components, and may operate using wired or wireless technology and may include communications over the Internet.

In the embodiment shown in FIG. 1, imaging apparatus 22 is shown as a multifunction machine that includes a controller 28, a print engine 30, a laser scan unit (LSU) 31, an imaging unit 32, a developer unit 34, a toner cartridge 35, a user interface 36, a media feed system 38 and media input tray 39, and a scanner system 40. Imaging apparatus 22 may communicate with computer 24 via a standard communication protocol, such as for example, universal serial bus (USB), Ethernet or IEEE 802.xx. A multifunction machine is also sometimes referred to in the art as an all-in-one (AIO) unit. Those skilled in the art will recognize that imaging apparatus 22 may be, for example, an electrophotographic printer/copier including an integrated scanner system 40 or a standalone scanner system 40.

Controller 28 includes a processor unit and associated memory 29, and may be implemented as one or more Application Specific Integrated Circuits (ASICs). Memory 29 may be any volatile and/or non-volatile memory such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the present embodiment, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuit 44, 45 may provide authentication functions, safety and operational interlocks, operating parameters and usage information related to imaging unit 32 and toner cartridge 35, respectively. Controller 28 serves to process print data and to operate print engine 30 during printing, as well as to operate scanner system 40 and process data obtained via scanner system 40.

Computer 24, which may be optional, may be, for example, a personal computer, electronic tablet, smartphone or other hand-held electronic device, including memory 60, such as volatile and/or non-volatile memory, an input device 62, such as a keyboard or keypad, and a display monitor 64. Computer 24 further includes a processor, input/output (I/O) interfaces, and may include at least one mass data storage device, such as a hard drive, a CD-ROM and/or a DVD unit (not shown).

Computer 24 includes in its memory a software program including program instructions that function as an imaging driver 66, e.g., printer/scanner driver software, for imaging apparatus 22. Imaging driver 66 is in communication with controller 28 of imaging apparatus 22 via communications link 26. Imaging driver 66 facilitates communication between imaging apparatus 22 and computer 24. One aspect of imaging driver 66 may be, for example, to provide formatted print data to imaging apparatus 22, and more particularly, to print engine 30, to print an image. Another aspect of imaging driver 66 may be, for example, to facilitate collection of scanned data.

In some circumstances, it may be desirable to operate imaging apparatus 22 in a standalone mode. In the standalone mode, imaging apparatus 22 is capable of functioning without computer 24. Accordingly, all or a portion of imaging driver 66, or a similar driver, may be located in controller 28 of imaging apparatus 22 so as to accommodate printing and scanning functionality when operating in the standalone mode.

Print engine 30 may include laser scan unit (LSU) 31, imaging unit 32, and a fuser 37, all mounted within imaging apparatus 22. The imaging unit 32 further includes a cleaner unit 33 housing a waste toner removal system and a photoconductive drum and developer unit 34 which is removably mounted within print engine 30 of imaging apparatus 32. In one embodiment, the cleaner unit 33 and developer unit 34 are assembled together and installed onto a frame of the imaging unit 32. The toner cartridge 35 is then installed on or in proximity with the frame in a mating relation with the developer unit 34. Laser scan unit 31 creates a latent image on the photoconductive drum in the cleaner unit 33. The developer unit 34 has a toner sump containing toner which is transferred to the latent image on the photoconductive drum to create a toned image. The toned image is subsequently transferred to a media sheet received in the imaging unit 32 from media input tray 39 for printing. Toner remnants are removed from the photoconductive drum by the waste toner removal system. The toner image is bonded to the media sheet in the fuser 37 and then sent to an output location or to one or more finishing options such as a duplexer, a stapler or hole punch.

Figure 2:
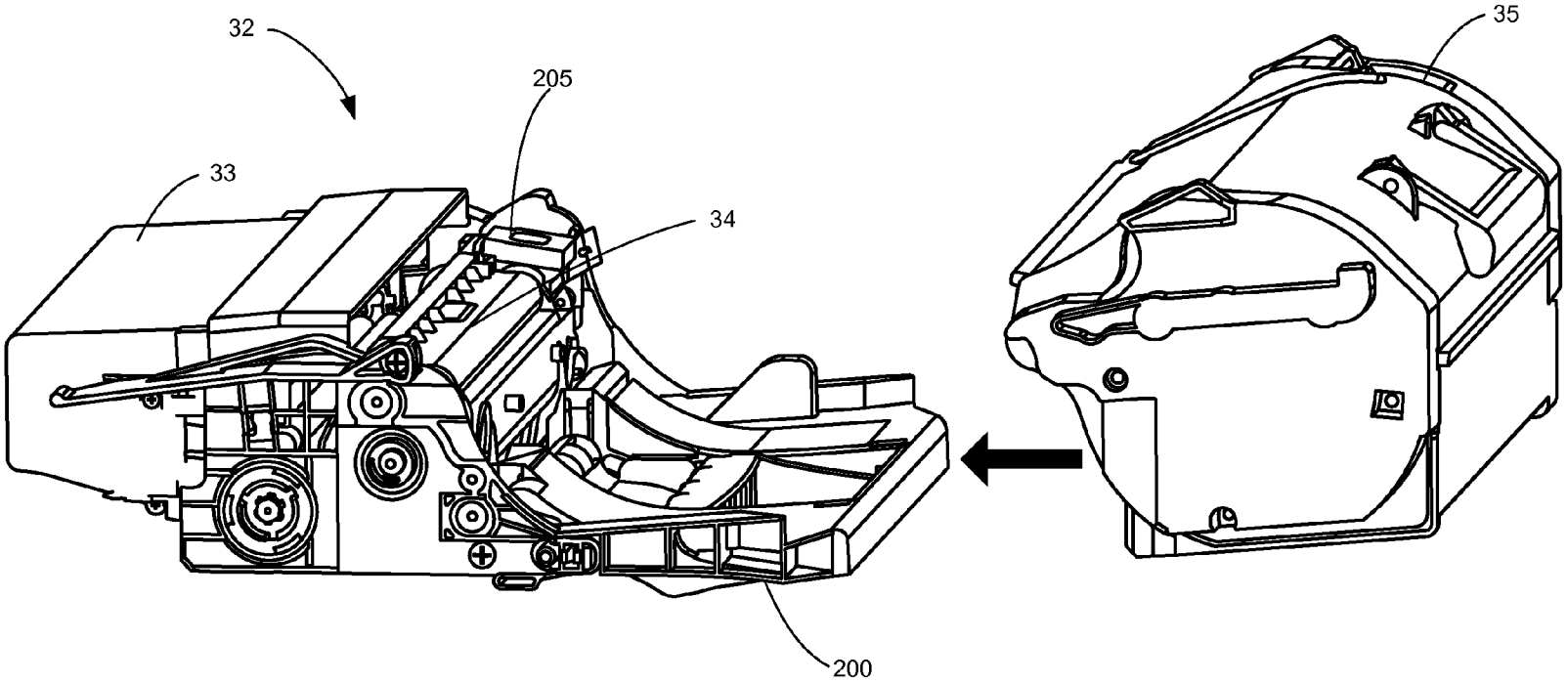
FIG. 2 is a perspective view of an imaging unit and toner cartridge of FIG. 1 in accordance with an example embodiment.

Referring now to FIG. 2, an example embodiment of imaging unit 32 is shown. Imaging unit 32, as illustrated, includes developer unit 34, cleaner unit 33 and a frame 200. Developer unit 34 and cleaner unit 33 are assembled onto or otherwise secured to frame 200. The imaging unit 32 without toner cartridge 35 is initially slidably received into imaging apparatus 22. The toner cartridge 35 is then slidingly inserted along frame 200 until it is operatively coupled to developer unit 34. This arrangement allows toner cartridge 35 to be separately removed and reinserted easily when replacing an empty toner cartridge or during media jam removal. The developer unit 34, cleaning unit 33 and frame 200 may also be readily slidingly removed and reinserted as a single unit when required. However, this would normally occur with less frequency than the removal and reinsertion of toner cartridge 35.

As mentioned, the toner cartridge 35 removably mates with the developer unit 34 of imaging unit 32. An exit port (not shown) on the toner cartridge 35 communicates with an inlet port 205 on the developer unit 34 allowing toner to be periodically transferred from the toner cartridge 35 to resupply the toner sump in the developer unit 34. It is understood, however, that imaging unit 32 and toner cartridge 35 may be formed as a single replaceable unit. It is further understood that cleaner unit 33, having the photoconductive drum, and developer unit 34 may be separate components and as such be separately removable from imaging apparatus 22.

Figure 3:
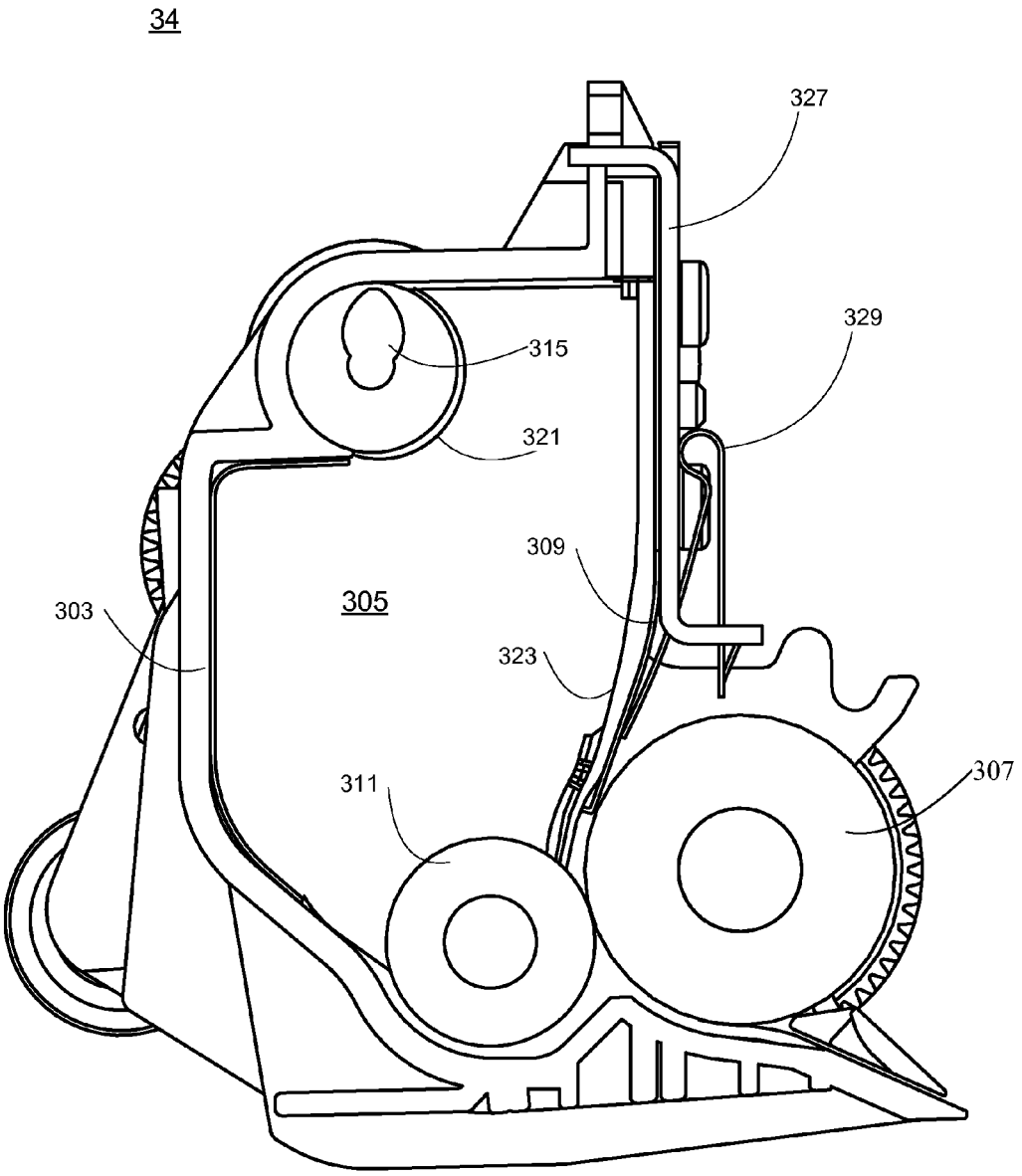
FIG. 3 is a cross-sectional view of the developer unit of the imaging unit in FIG. 2 according to an example embodiment.

Referring now to FIG. 3, an example embodiment of the developer unit 34 is shown. Developer unit 34 includes a housing 303 enclosing a toner sump 305 sized to hold a quantity of toner. A developer roll 307, a doctor blade 309, and a toner adder roll 311 may be mounted within toner sump 305. The toner adder roll 311 moves the toner supplied from the toner cartridge 35 to developer roll 307 while the doctor blade 309 provides a metered, uniform layer of toner on developer roll 307. A rotating auger 315 and gutter 321 may be disposed along a side of the toner sump 305 proximal to toner inlet port 205 so as to distribute incoming toner substantially evenly across toner sump 305. A rotatable toner paddle or toner agitator (not shown) having one or more blades may be positioned within toner sump 305 to stir and move toner towards toner adder roll 311 and developer roll 307. In stirring and moving toner, the rotating toner agitator prevents toner particles from forming larger clumps within toner sump 305.

Toner inlet port 205 on housing 303 aligns with the exit port of toner cartridge 35 when toner cartridge 35 is installed along frame 200 and mated with developer unit 34. In one example form, toner inlet port 205 may be larger in area than the exit port of toner cartridge 35.

Doctor blade 309 is disposed along and engages with developer roll 307 to provide a substantially uniform layer of toner thereon for subsequent transfer to a latent image on photoconductive drum in imaging unit 32. In order to prevent toner leakage, a seal member 323 is disposed along each end of developer unit 34. Each seal member 323 engages with and, in some embodiments, at least partly wraps around a longitudinal end portion of developer roll 307. To fully contain toner within developer unit 34, seal members 323 also contact doctor blade 309 at its longitudinal ends.

Seal members 323 prevent toner leakage through contact with doctor blade 309 and developer roll 307. Such contact undesirably results in nonuniform pressure on and/or between doctor blade 309 and developer roll 307 by experiencing a greater force at the longitudinal ends thereof than the middle. To reduce the effect of these additional forces acting on doctor blade 309 and developer roll 307 by seal members 323, example embodiments of developer unit 34 include a bias mechanism for providing a counterforce at each end of doctor blade 309 to at least partly offset the forces applied by seal members 323. In this way, forces acting between the doctor blade 309 and developer roll 307 are more uniform, thereby leading to printed images having less defects and developer unit 34 having a longer useful life.

Figure 4:
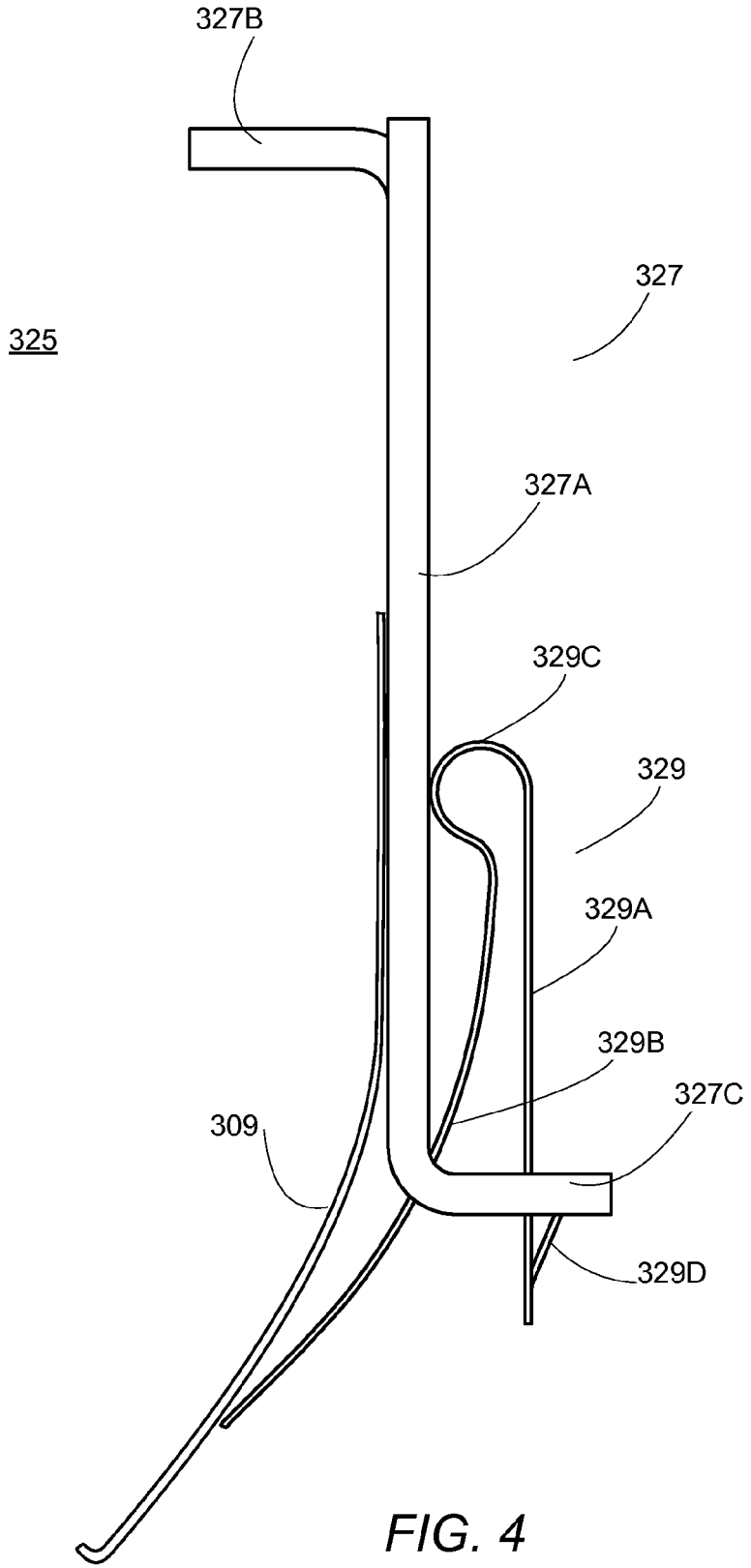
FIG. 4 is a side elevational view of the doctor blade assembly of the developer unit of FIG. 3.
Figure 5:
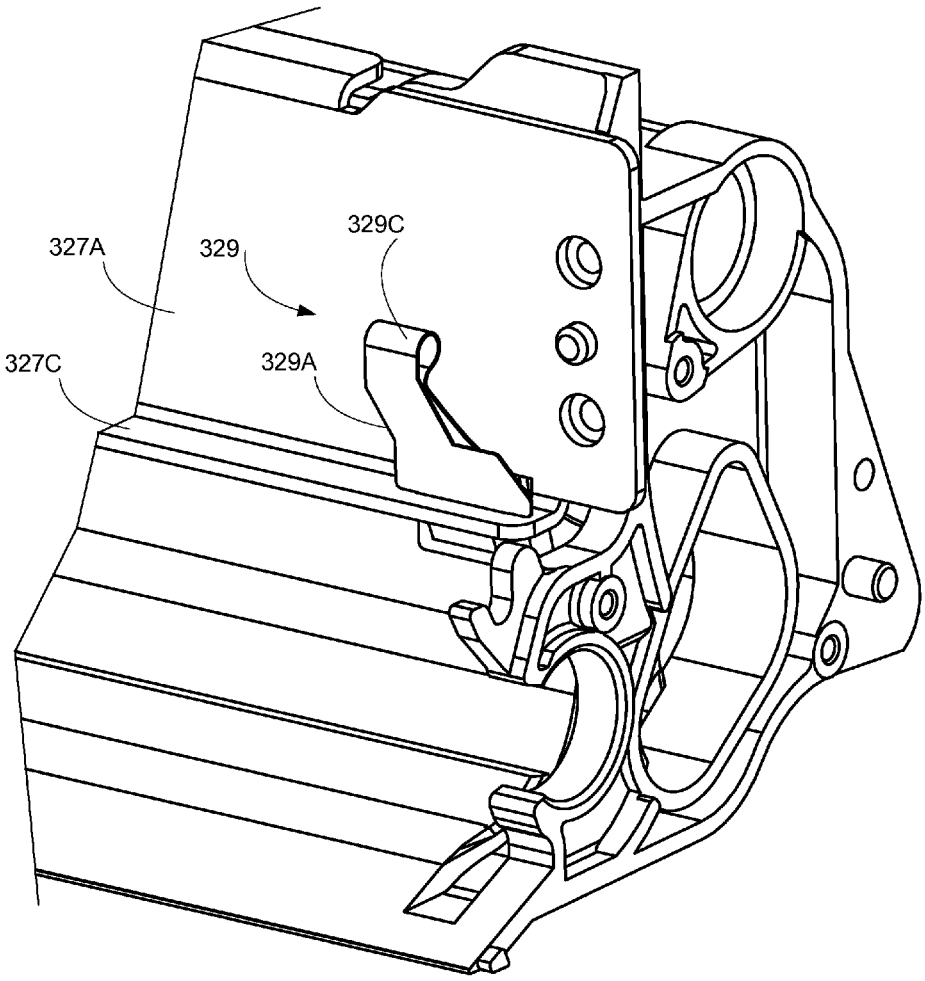
FIG. 5 is a perspective view of a side end portion of the developer unit of FIG. 3.
Figure 6:
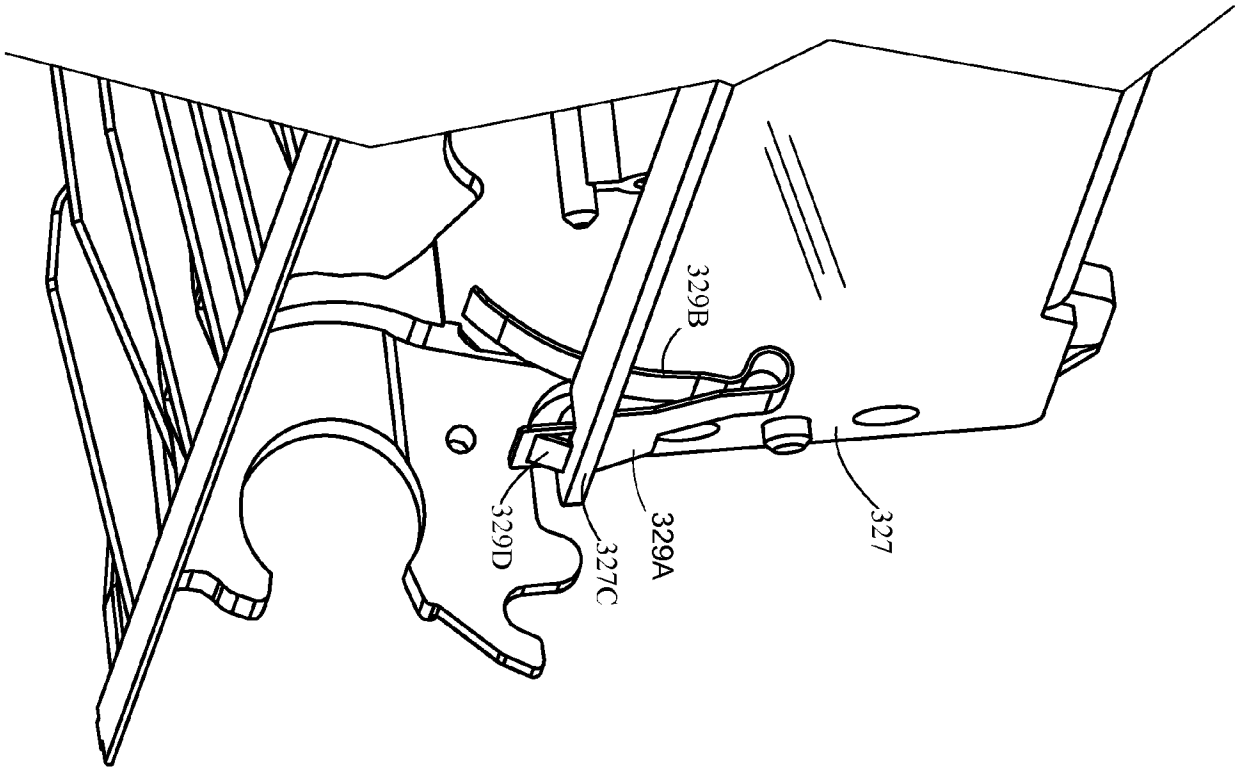
FIG. 6 is another perspective view of the side end portion of the developer unit of FIG. 3.

With respect to FIGS. 4-6, there is shown the bias mechanism for doctor blade 309 according to an example embodiment. A doctor blade assembly 325 includes a support bracket 327 to which doctor blade 309 is secured. Support bracket 327 includes apertures located along each longitudinal end portion for securing to housing 303 of developer unit 34 via screws or the like. Support bracket 327 may include a substantially planar portion 327A to which doctor blade 309 is secured, a top ledge 327B for contacting housing 303 when doctor blade assembly 325 is connected thereto, and a bottom ledge 327C which extends from a lower end portion of substantially planar portion 327A. In an example embodiment, the bias mechanism may include a pair of spring members 329 operatively coupled to support bracket 327 for presenting a counterforce to the forces provided to doctor blade 309 by seal members 323.

Spring member 329 may include arm members 329A and 329B that are connected together via connecting portion 329C such that arm members 329A and 329B are substantially resiliently deflectable relative to each other. Arm member 329B may have a concave surface facing doctor blade 309. An aperture or slot is defined through a lower portion of substantially planar portion 327A and bottom ledge 327C along each longitudinal end portion of support bracket 327. Each aperture allows for a spring member 329 to be inserted therethrough, with a distal end of arms 329A and 329B extending from a lower portion of support bracket 327 and connecting portion 329C of spring member 329 positioned above bottom ledge 327C and against substantially planar portion 327A. When positioned in this way with respect to support bracket 327, a distal end of arm 329B of spring member 329 flexibly urges a distal portion of doctor blade 309 away from support bracket 327, as shown in FIG. 4. With each spring member 329 being positioned along a longitudinal end portion of doctor blade 309 in proximity to the location of contact between doctor blade 309 and a seal member 323, the distal end of arm 329B of spring member 329 imposes a bias force against a side of doctor blade 309 which largely offsets a force provided by corresponding seal member 323 onto the opposite side of doctor blade 309.

Spring members 329 may be constructed from a metal or other composition which allows for arm members 329A and 329B to be resiliently deflectable relative to each other.

With reference to FIGS. 4 and 6, the distal end portion of arm 329A of spring member extends through the aperture in support bracket 327 so that arm 329A is stably positioned against an end of the aperture. Tab member 329D of spring member 329 engages with the lower surface of bottom ledge 327C of support bracket 327 so as to substantially stabilize spring member 329 relative to support bracket 327 and to substantially prevent disengagement of spring member 329 therefrom.

Figure 7:
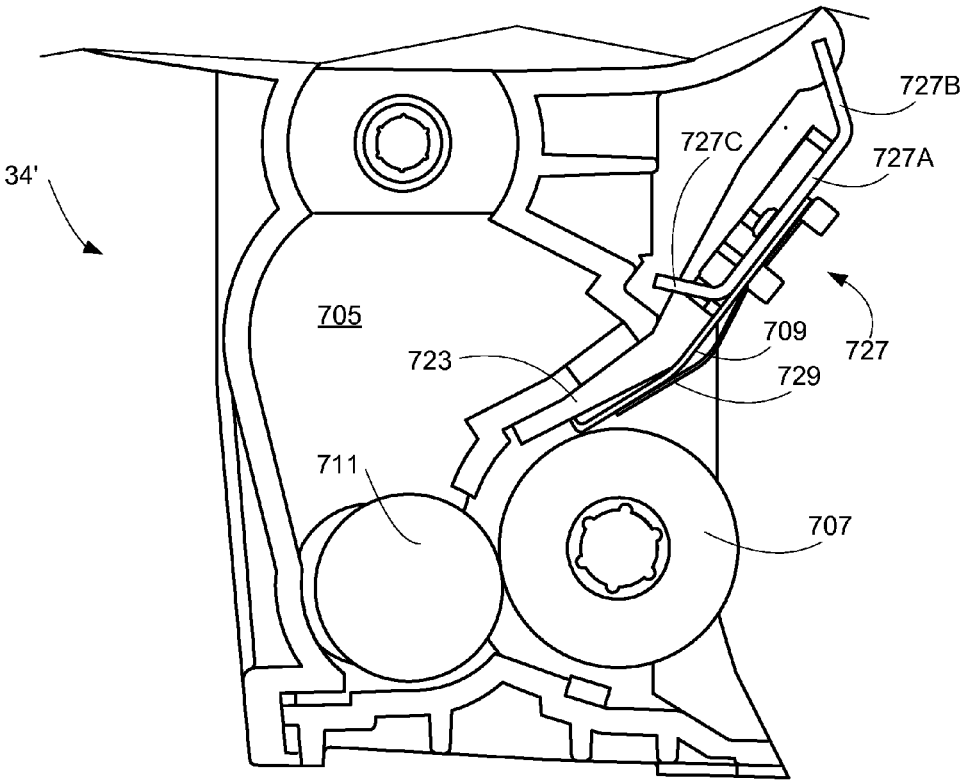
FIG. 7 is a cross-sectional view of a developer unit according to another example embodiment.
Figure 9:
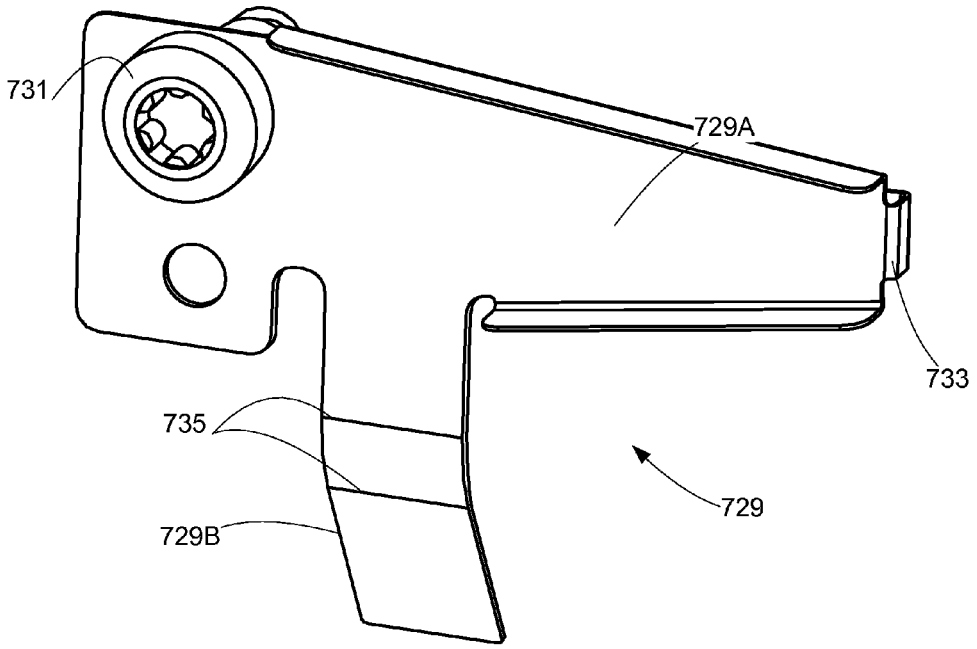
FIG. 9 is an elevational view of a bias member of the doctor blade assembly of FIG. 8.
Figure 8:
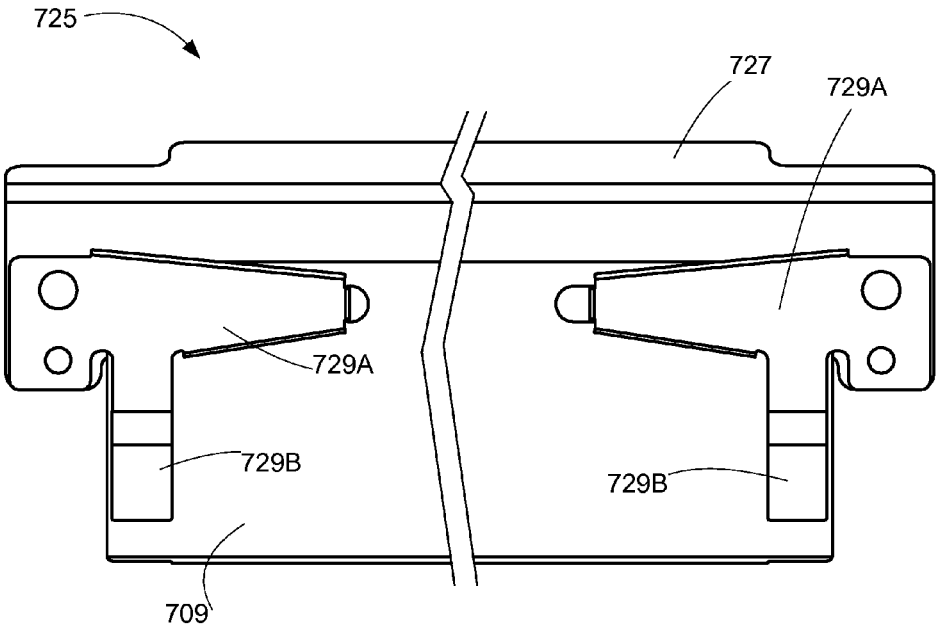
FIG. 8 is an elevational view of a doctor blade assembly of the developer unit of FIG. 7.
Figure 10:
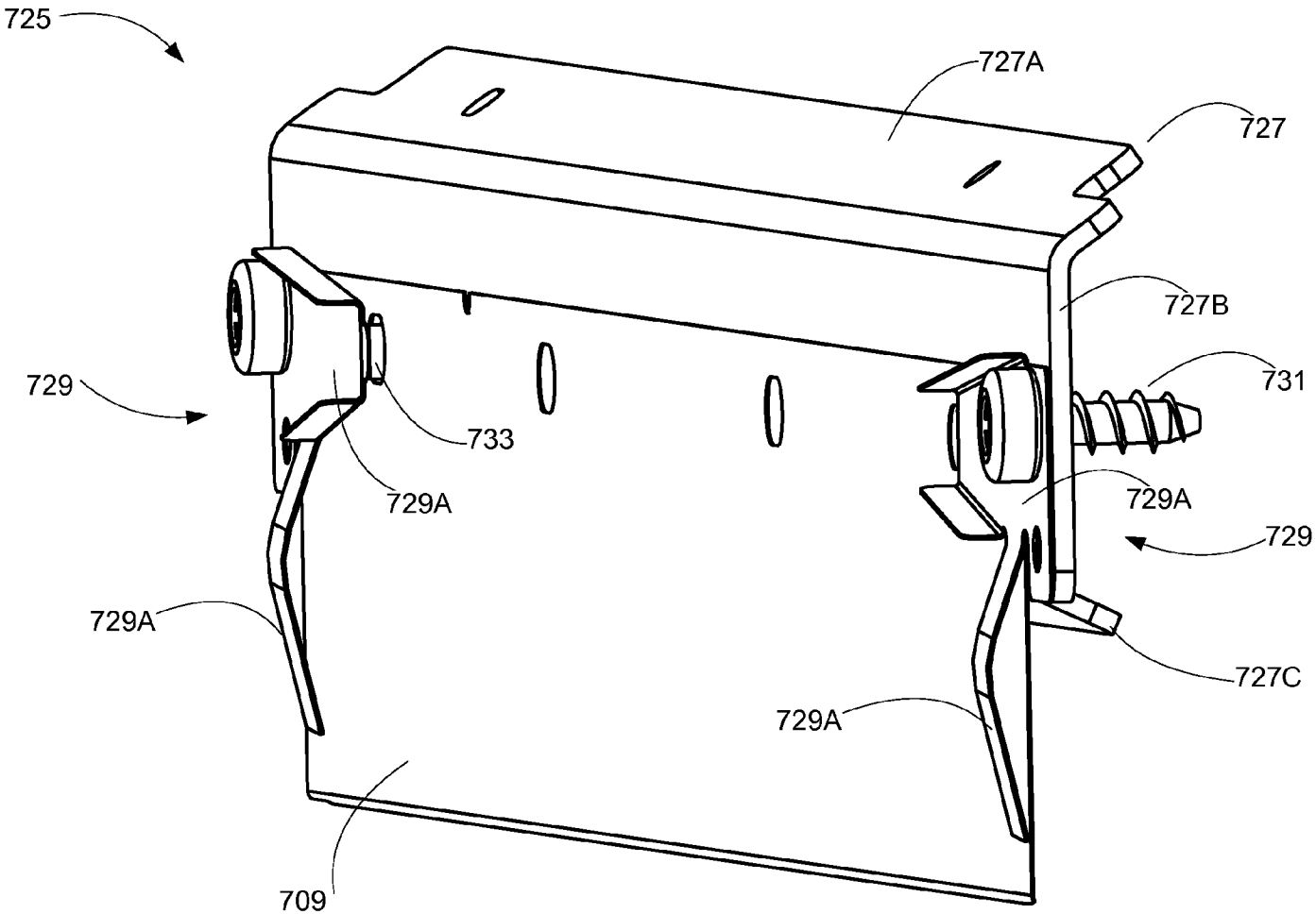
FIG. 10 is a perspective view of the doctor blade assembly of the developer unit of FIG. 7.
Figure 11:
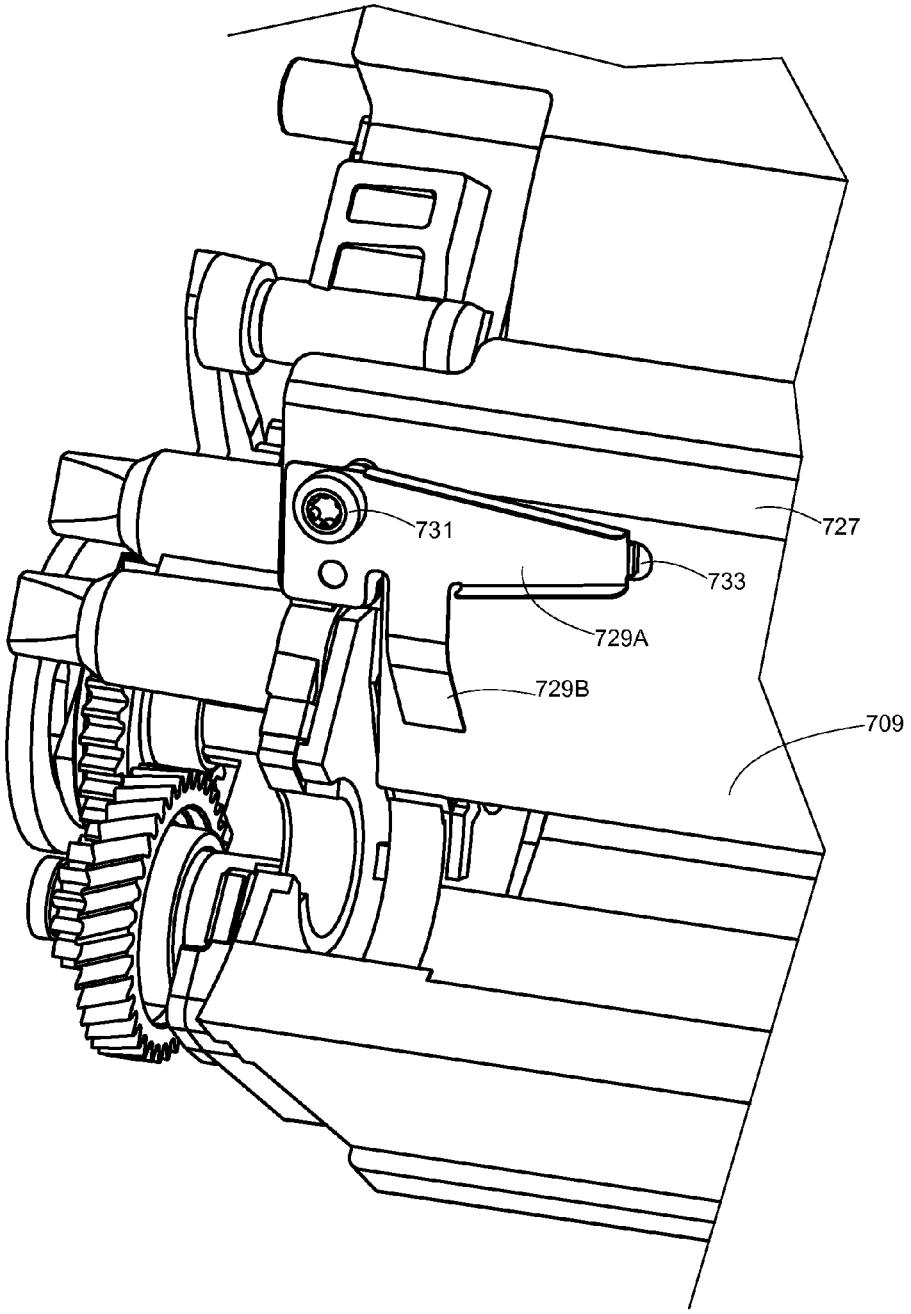
FIG. 11 is a perspective view of a side portion of the developer unit of FIG. 7.

Referring now to FIG. 7, there is shown a bias mechanism according to another example embodiment of the present disclosure. In this example embodiment, developer unit 34' may be integrally combined into a toner cartridge and may include a developer roll 707, a doctor blade 709, and a toner adder roll 711 mounted within toner sump 705. The toner adder roll 711 moves the toner supplied from the toner cartridge 35 to developer roll 707 while the doctor blade 709 provides a metered, uniform layer of toner on developer roll 707. Developer unit 34' may utilize a rotating auger and gutter (not shown) disposed along a side of the toner sump 705 proximal to a toner inlet port so as to distribute incoming toner substantially evenly across toner sump 705. Developer unit 34' may also utilize a rotatable toner paddle or toner agitator (not shown) having one or more blades to stir and move toner towards toner adder roll 711 and developer roll 707. In stirring and moving toner, the rotating toner agitator prevents toner particles from forming larger clumps within toner sump 705.

Doctor blade 709 is disposed along and engages with developer roll 707 to provide a substantially uniform layer of toner thereon for subsequent transfer to a photoconductive drum. In order to prevent toner leakage, a seal member 723 is disposed along each end of developer unit 34'. Each seal member 723 engages with longitudinal end portions of developer roll 707 and doctor blade 709 to substantially fully contain toner within developer unit 34'.

Seal members 723 prevent toner leakage through contact with doctor blade 709 and developer roll 707. To reduce the effect of additional forces acting on doctor blade 709 and developer roll 707 by seal members 723, a bias mechanism provides a counterforce at each end of doctor blade 709 to at least partly offset the forces applied by seal members 723. In this way, forces acting on doctor blade 709 and developer roll 707 are more uniform, thereby leading to printed images having less defects.

With respect to FIGS. 7-11, there is shown the bias mechanism for doctor blade 709 according to an example embodiment. A doctor blade assembly 725 includes a support bracket 727 to which doctor blade 709 is secured. Support bracket 727 includes apertures located along each longitudinal end portion for securing to housing of developer unit 34' via screws or the like. Support bracket 727 may include a substantially planar portion 727A to which doctor blade 709 is secured, a top ledge 727B for contacting the developer unit housing when doctor blade assembly 725 is connected thereto, and a bottom ledge 727C which extends from a lower end portion of substantially planar portion 727A. The bias mechanism may include a pair of spring members 729 operatively coupled to support bracket 727 for presenting a counterforce to the forces provided to doctor blade 709 by seal members 723.

A spring 729 is disposed at each end of doctor blade 709 and includes a base portion 729A from which an arm member 729B extends. Base portion 729A may include a substantially flat portion for securing to portion 727A of support bracket 727. Base portion 729A may include at least one aperture for securing to support bracket 727 with a screw 731 or the like. Base portion 729A of spring 729 may further include a tab 733 (FIG. 9) which extends from the substantially flat portion thereof at an end opposite the aperture and screw 731. Tab 733 may engage with a mating aperture disposed along support bracket 727 and thereby combine with screw 731 to stably secure base portion 729A of spring 729 in a substantially fixed position along support bracket 727. Screw 731 may also be utilized to secure doctor blade assembly 725 to the housing of developer unit 34'.

As shown in FIGS. 7-11, arm member 729B extends from base portion 729A such that a distal end portion of arm member 729B contacts and provides a bias force to doctor blade 709. Arm member 729B may initially extend from base portion 729A at an outward angle, relative to base portion 729A and to doctor blade 709, and include one or more bends or creases 735 (see FIG. 9) that change the position of the distal end of arm member 729B so as to contact and provide a bias force to doctor blade 709. Such angling and bends result in the arm member 729B having a generally concave shape facing blade member 709. Because each spring 729 is disposed along doctor blade 709 so as to be substantially adjacent a seal member 723, the bias force presented by spring 729 onto blade 709 largely offsets the force presented thereon by seal member 723. With forces acting on doctor blade 709 and hence developer roll 707 by seal members 723 being largely offset by forces from springs 729, doctor blade 709 does not wear as quickly and print defects are seen to reduce.

It is understood that instead of arm member 729B having one or more bends or creases 735 to form a generally concave shape, arm member 729B may have a curved shape without bends in forming a concave shape.

Figure 12:
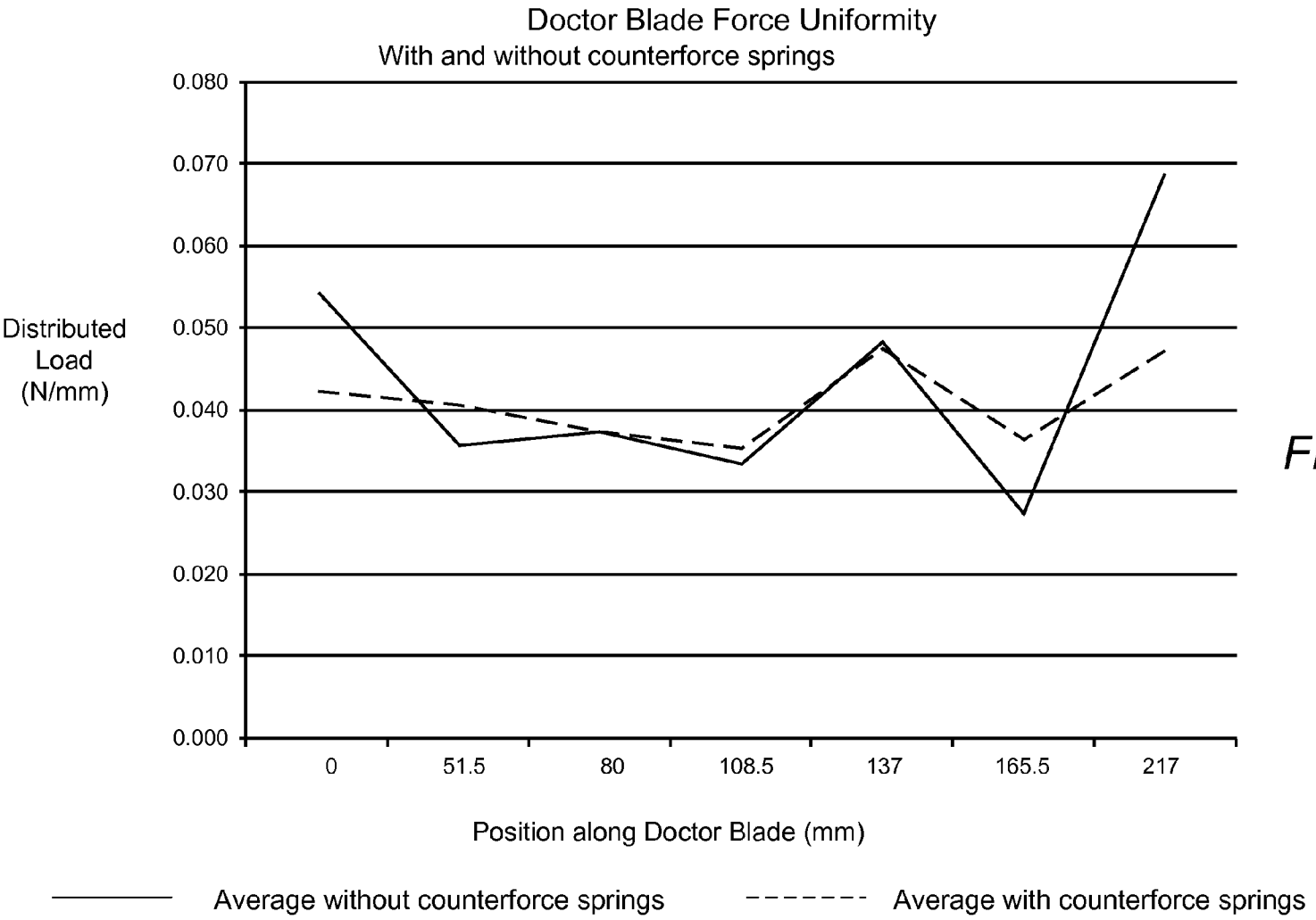
FIGS. 12-14 are test results of the doctor blade assembly of FIG. 8.
Figure 13:
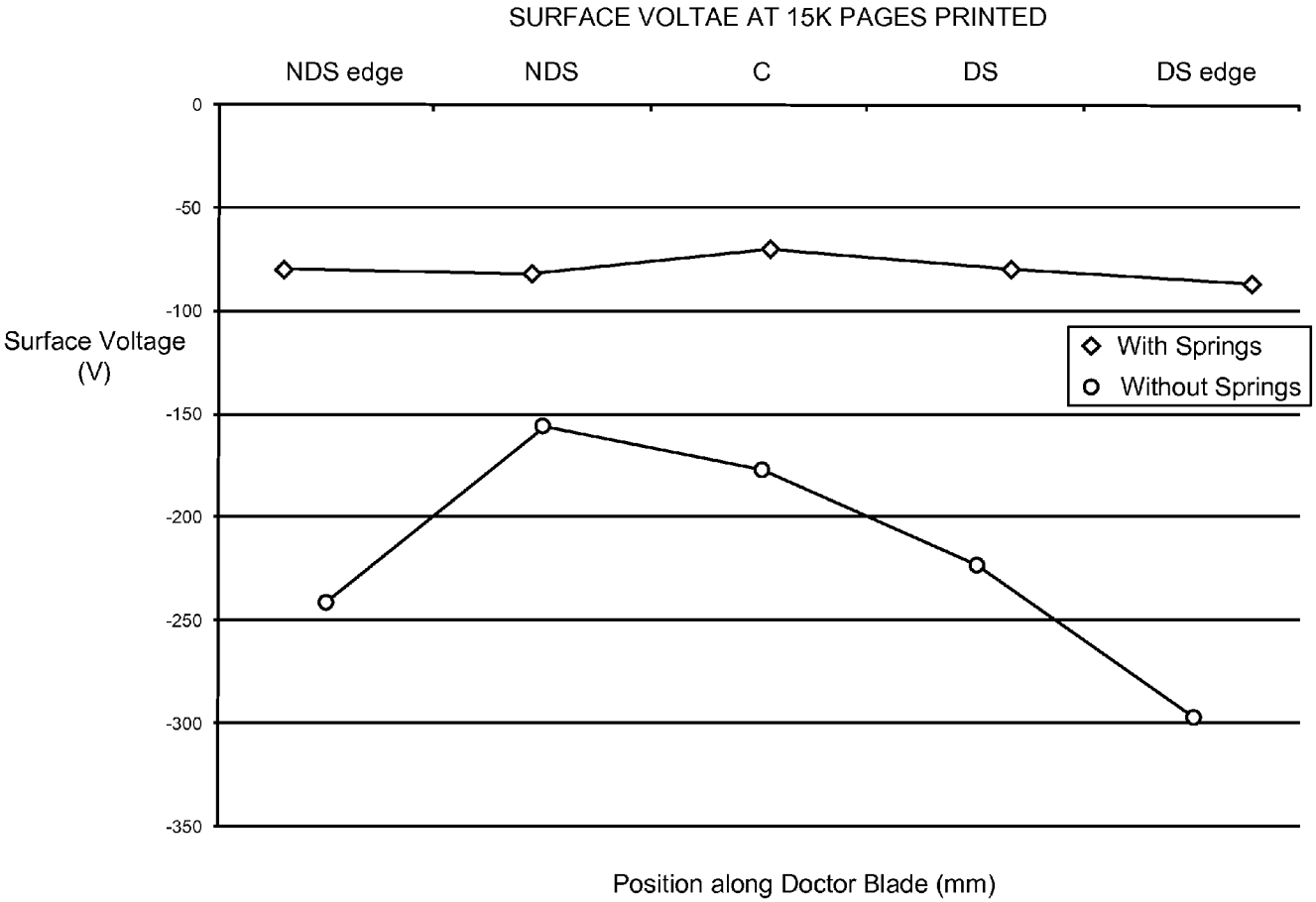
Figure 14:
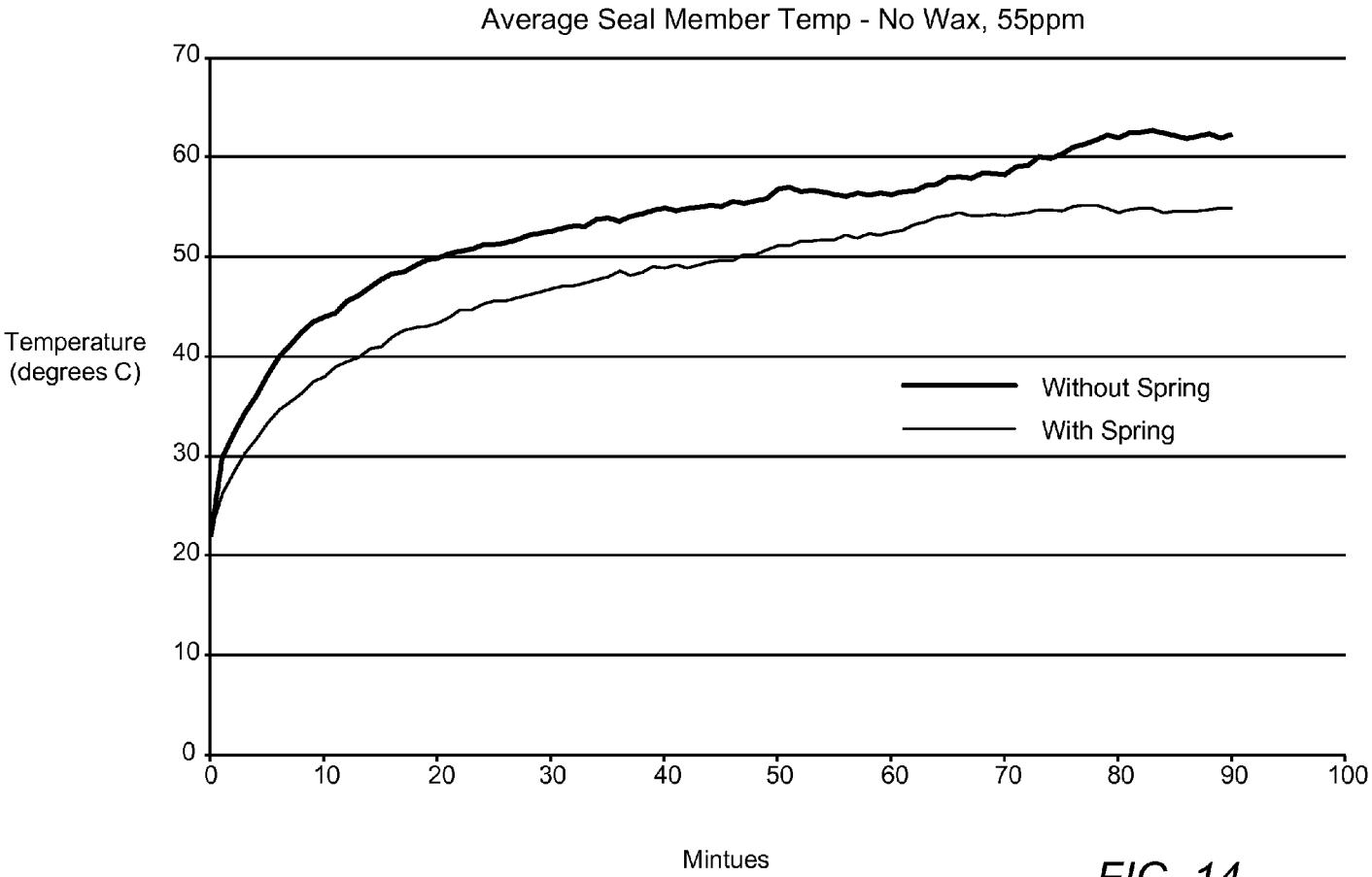

FIGS. 12-14 compare test results of the doctor blade assembly of FIGS. 3 and 7 comparing the use of spring members as discussed above to a doctor blade assembly without spring members. FIG. 12 shows that doctor blades having spring members have a substantially more uniform loading across its length than a doctor blade assembly without spring members. FIG. 13 shows that the use of spring members results in a reduced and more uniform surface voltage across the doctor blade. FIG. 14 shows that the use of spring members as described reduces the average temperature at the seal members.

Figure 15:
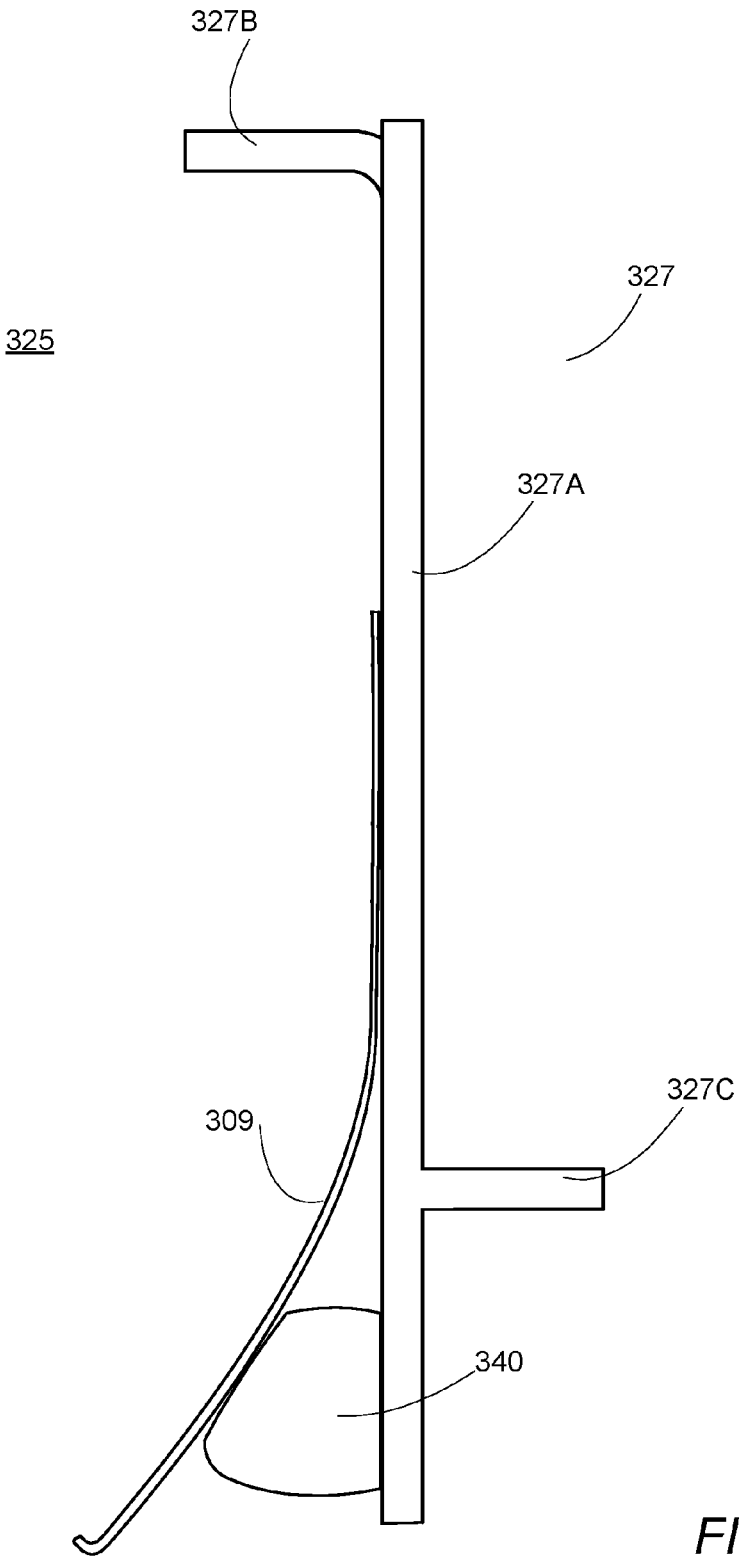
FIG. 15 is an elevational view of a doctor blade assembly of a developer unit of FIG. 3 according to another example embodiment.

It is understood that the bias mechanism for presenting counterforces to substantially offset the forces caused by seal members 323 and 723 may be implemented in any of a variety of ways. For example, FIG. 15 illustrates a bias mechanism according to another example embodiment. In this embodiment, support bracket 327 may extend beyond bottom ledge 327C so as to be substantially adjacent a distal end portion of doctor blade 309. The bias mechanism may include a piece of foam 340 or other compressible material which extends from end portions of each support bracket 327 between doctor blade 309 and support bracket 327. The compressed foam 340 generates a force onto doctor blade 309 which substantially offsets the force acting on doctor blade 309 by seal members 323.

In the above described embodiments, the bias mechanism is coupled to the bracket support of the doctor blade. In alternative embodiments, the bias mechanism is instead coupled to another stationary part of imaging unit 32. For example, the bias mechanism may be secured to housing 303 of developer unit 34, either directly or indirectly via a stationary component or other component that is itself secured to housing 303 of developer unit 34. With respect to the embodiment of FIGS. 3-6, arm member 329A of spring 329 may be coupled, directly or indirectly, to housing 303 of imaging unit 32 without being connected to or associated with support bracket 327. With respect to FIGS. 7-11, base portion 729A may be coupled, directly or indirectly, to the housing of developer unit 34' without being coupled to or associated with support bracket 727.

It is understood that the doctor blade bias mechanism can be utilized in a developer unit irrespective of the particular architecture selected for the toner cartridge, developer unit and photoconductive unit. For example, the doctor blade bias mechanism may be utilized in developer units forming part of a removable imaging unit, such as imaging unit 32, and in developer units forming part of a removable toner cartridge.

The foregoing description of several methods and embodiments have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A removable unit for an electrophotographic imaging device, comprising:

a housing;

a rotatable roll disposed within the housing;

at least one seal member coupled within the housing along at least one side thereof, a portion of the at least one seal member engaging an end portion of the rotatable roll so as to prevent toner from leaking from the housing; and a blade assembly coupled to the housing, comprising a support bracket secured to the housing, a blade member coupled to the support bracket and being positioned so that a distal end thereof is disposed between and engages with the rotatable roll and the at least one seal member, and at least one bias member having a first end portion disposed in a substantially stable position within the housing and a second end portion which engages with the blade member so as to present a force that at least partly offsets a force presented to the blade member by the at least one seal member.

2. The removable unit of claim 1, wherein the at least one bias member comprises a spring member.

3. The removable unit of claim 2, wherein the at least one bias member includes a concave portion facing the blade member.

4. The removable unit of claim 3, wherein the at least one bias member has at least one bend forming the concave portion.

5. The removable unit of claim 3, wherein the concave portion of the at least one bias member contacts the blade member.

6. The removable unit of claim 1, wherein the support bracket includes a first surface against which the blade member is coupled, and the first end portion of the at least one bias member is disposed along the first surface of the support bracket.

7. The removable unit of claim 6, wherein a first surface of the blade member is positioned against the first surface of the support bracket, and the second end portion of the at least one bias member is disposed along a second surface of the blade member opposite the first surface thereof.

8. The removable unit of claim 1, wherein the support bracket includes a first surface against which a first surface of the blade member is coupled, and the second end portion of the at least one bias member contacts the first surface of the blade member.

9. The removable unit of claim 1, wherein the support bracket includes a first surface against which a first surface of the blade member is coupled, and the first end portion of the at least one bias member contacts a second surface of the support bracket opposite the first surface thereof.

10. The removable unit of claim 9, wherein the first and second surfaces of the support bracket are substantially parallel to each other.

11. The removable unit of claim 1, wherein the support bracket includes a first substantially planar portion to which the blade member is attached and a second substantially planar portion extending from the first substantially planar portion, and the first end portion of the at least one bias member is attached to the second substantially planar portion.

12. The removable unit of claim 11, wherein a substantially central portion of the at least one bias member is positioned against the first substantially planar portion of the support bracket and the second end portion of the at least one bias member extends through an aperture of the support bracket so as to be biased against the blade member, the second end portion of the at least one bias member being deflectable relative to the first end portion thereof.

13. The removable unit of claim 11, wherein the first substantially planar portion of the support bracket and the second substantially planar portion of the support bracket are substantially perpendicular to each other.

14. The removable unit of claim 1, wherein the at least one bias member is a deformable member having a first surface attached to at least one of the housing and the support bracket and a second surface that contacts the blade member.

15. A blade assembly for an imaging system, comprising:

a blade member having a first longitudinal edge for contacting a rotatable cylindrical member of the imaging system;

a bracket member operatively connected to the blade member; and at least one bias member having a first end portion disposed along a first longitudinal end portion of the bracket member and a second end portion contacting a distal portion of the blade member so as to present a force thereon, wherein the at least one bias member comprises a plurality of bias members, a first bias member being coupled along the first longitudinal end portion of the bracket member and a second bias member being coupled along a second longitudinal end portion thereof.

16. The blade assembly of claim 15, wherein the at least one bias member comprises a spring in which the first end portion thereof is secured to the bracket member and the second end portion thereof is biased against the distal portion of the blade member.

17. The blade assembly of claim 15, wherein the bracket member comprises a first substantially planar member to which the blade member is secured and a second member extending therefrom, the bracket member including an aperture defined through the first substantially planar member and the second member, the first end portion of the at least one bias member is secured to the second member of the bracket member and the second end portion of the at least one bias member extends through the aperture and contacts the blade member.

18. The blade assembly of claim 17, wherein a central portion of the at least one bias member contacts the first substantially planar member.

19. The blade assembly of claim 1, wherein the first substantially planar member of the bracket member and the second member of the bracket member are substantially perpendicular to each other.

20. The blade assembly of claim 17, wherein the second substantially planar member of the bracket member extends directly from the first substantially planar member thereof in a substantially perpendicular direction.

21. The blade assembly of claim 15, wherein the bracket member comprises a first surface to which the blade member is secured, and the at least one bias member is secured along the first surface of the bracket member.

22. The blade assembly of claim 21, wherein the first end portion of the at least one bias member contacts a second surface of the bracket member opposite the first surface thereof, the first and second surfaces of the bracket member being substantially parallel to each other.

23. The blade assembly of claim 15, wherein the at least one bias member includes a substantially concave surface and a substantially convex surface, the substantially concave surface being adjacent to and facing the blade member.

24. The blade assembly of claim 23, wherein the substantially concave surface of the at least one bias member directly contacts the blade member.

25. The blade assembly of claim 15, wherein the at least one bias member comprises a deformable member disposed between the bracket member and the blade member.

26. A blade assembly for an imaging system, comprising:

a blade member having a first longitudinal edge for contacting a rotatable cylindrical member of the imaging system;

a bracket member operatively connected to the blade member; and at least one bias member having a first end portion disposed along a first longitudinal end portion of the bracket member and a second end portion contacting a distal portion of the blade member so as to present a force thereon, wherein the bracket member comprises a first substantially planar member to which the blade member is secured and a second member extending therefrom, the bracket member including an aperture defined through the first substantially planar member and the second member, the first end portion of the at least one bias member is secured to the second member of the bracket member and the second end portion of the at least one bias member extends through the aperture and contacts the blade member.

27. The blade assembly of claim 26, wherein a central portion of the at least one bias member contacts the first substantially planar member.

28. The blade assembly of claim 26, wherein the first substantially planar member of the bracket member and the second member of the bracket member are substantially perpendicular to each other.

29. The blade assembly of claim 26, wherein the second substantially planar member of the bracket member extends directly from the first substantially planar member thereof in a substantially perpendicular direction.

30. A blade assembly for an imaging system, comprising:

a blade member having a first longitudinal edge for contacting a rotatable cylindrical member of the imaging system;

a bracket member operatively connected to the blade member; and at least one bias member having a first end portion disposed along a first longitudinal end portion of the bracket member and a second end portion contacting a distal portion of the blade member so as to present a force thereon, wherein the bracket member comprises a first surface to which the blade member is secured, and the at least one bias member is secured along the first surface of the bracket member.

31. The blade assembly of claim 30, wherein the first end portion of the at least one bias member contacts a second surface of the bracket member opposite the first surface thereof, the first and second surfaces of the bracket member being substantially parallel to each other.

32. A blade assembly for an imaging system, comprising:

a blade member having a first longitudinal edge for contacting a rotatable cylindrical member of the imaging system;

a bracket member operatively connected to the blade member; and at least one bias member having a first end portion disposed along a first longitudinal end portion of the bracket member and a second end portion contacting a distal portion of the blade member so as to present a force thereon, wherein the at least one bias member includes a substantially concave surface and a substantially convex surface, the substantially concave surface being adjacent to and facing the blade member.

33. The blade assembly of claim 32, wherein the substantially concave surface of the at least one bias member directly contacts the blade member.

34. A blade assembly for an imaging system, comprising:

a blade member having a first longitudinal edge for contacting a rotatable cylindrical member of the imaging system;

a bracket member operatively connected to the blade member; and at least one bias member having a first end portion disposed along a first longitudinal end portion of the bracket member and a second end portion contacting a distal portion of the blade member so as to present a force thereon, wherein the at least one bias member comprises a deformable member disposed between the bracket member and the blade member.

* * * * *